United States Patent [19]

Leguen et al.

[11] Patent Number: 5,065,419

[45] Date of Patent: Nov. 12, 1991

[54] X-RAY TUBE WITH LOW EXTRA-FOCAL RADIATION

[75] Inventors: Jacques Leguen; Emile Gabbay, both of Paris, France

[73] Assignee: General Electric CGR S.A., Issy les Moulineaux, France

[21] Appl. No.: 460,324

[22] PCT Filed: Jun. 17, 1988

[86] PCT No.: PCT/FR88/00319

§ 371 Date: Dec. 26, 1989

§ 102(e) Date: Dec. 26, 1989

[87] PCT Pub. No.: WO88/10508

PCT Pub. Date: Dec. 29, 1988

[30] Foreign Application Priority Data

Jun. 26, 1987 [FR] France ..... 87 09030

[51] Int. Cl.[5] ..... H01J 35/10; H01J 35/22; H01J 35/26

[52] U.S. Cl. ..... 378/125; 378/127; 378/121; 378/138; 378/143; 378/144; 378/145

[58] Field of Search ..... 378/125, 121, 127, 137, 378/138, 143, 144, 145

[56] References Cited

U.S. PATENT DOCUMENTS 3,414,754 11/1966 Elsas ..... 378/144
3,973,156 8/1976 Schreiber ..... 378/125

FOREIGN PATENT DOCUMENTS 1200962 9/1965 Fed. Rep. of Germany .
2258704 8/1975 France .
2548447 1/1985 France .
1190470 5/1970 United Kingdom .

*Primary Examiner*—Edward P. Westin
*Assistant Examiner*—Don Wong
*Attorney, Agent, or Firm*—Oblon, Spivak, McClelland, Maier & Neustadt

[57] ABSTRACT

The invention relates to an X-ray tube used to obtain radiological images in which sharpness and contrast are improved. To this end, the X-ray tube has an anode consisting, at least partially, of a massive layer made of an X-ray emitting material in which at least one hollow part demarcates a surface exposed to a beam of electrons.

8 Claims, 2 Drawing Sheets

X-RAY TUBE WITH LOW EXTRA-FOCAL RADIATION

BACKGROUND OF THE INVENTION

1. Field of the Invention

The invention concerns an X-ray tube of the kind commonly used in radiology, in diagnosis by X-ray for example and particularly concerns means for reducing extra-focal radiation.

An X-ray tube comprises essentially two electrodes: a cathode and an anode contained in a glass sphere under vacuum and respectively fixed to the ends of this glass sphere. The cathode generally consists of a tungsten filament housed in a metallic part which is shaped appropriately so as act as an electronic lens and is called the focusing cap. The anode may consist of a cylindrical copper mass which bears, facing the filament, a plate made of a high-level X-ray emitting material, for example tungsten, in the case of a fixed anode tube. In the case of a rotating anode tube, the anode often consists of a massive disk, made of molybdenum or graphite for example, generally coated with tungsten. Of course, for special applications, other materials that those mentioned above may be used for the anode.

When the filament is made incandescent, and when a positive voltage of a few KV with respect to the cathode is applied to the anode, electrons emitted by the filament are accelerated towards the anode by the electrical field and bombard the anode or anti-cathode on a surface called the focal spot. The focal spot becomes the main source of X-ray emission. X-radiation is produced throughout the zone located in front of the anti-cathode except for grazing incidences.

The radiation yield of an X-ray tube depends on factors such as the current of electrons, the potential difference between the cathode and the anode and the atomic number of the material constituting the target on which the focal spot is formed.

In medical diagnosis, where the quality of a radiological exposure is of vital importance, the most important properties of the X-radiation source are those affecting the following two essential factors: sharpness and contrast.

Two types of fuzziness, having different causes, may affect sharpness:

geometrical fuzziness which results from the dimensions of the focal spot;

kinetic fuzziness due to the movement of the examined organ while the picture is being taken.

As regards factors of contrast, assuming moreover that the radiation quality and receiver are optimised so as to reveal those factors of contrast which depend on the source, the following may be cited:

the distribution in density of the electrons on the surface of the focal spot;

the place at which the electrons striking the anode outside the focal spot, called secondary electrons, fall or any other unwanted X-ray emission outside the focal spot. It must be pointed out that these unwanted sources of X-radiation are generally located on the anode itself, often near the focal spot, owing to the fact that electrons fall outside the focal spot, either coming from the cathode or bouncing off the focal spot, and create X-radiation called extra-focal radiation.

The geometrical fuzziness resulting from the dimensions of the focal spot affect the separating capacity, and the extra-focal radiation affects the attenuation of the contrast.

Studies on sharpness and contrast factors, such as those based on the known concept of modulation transfer function, where the investigation relates to the sinusoidal absorption image of an object, clearly show that the more extended the X-ray source, the more the image of an object is affected by a pepper-and-salt type of fuzziness due to the superimposition of a large number of images with points of low intensity as compared with the intensity of the focal spot.

2. Description of the Prior Art

In the prior art, it is sought to reduce these faults by the following two methods:

the first method, which can be applied especially to an anode with a massive target made of X-ray emitting material, consists in placing a collimator inside the casing of the tube, in the immediate vicinity of the surface on which the focal spot is formed. The implementation of this approach has great difficulties, especially as regards preserving proper electrical insulation between the anode and the cathode;

the second method can be applied especially to an anode with a basic structure consisting of a material that does not emit X-rays or emits them at a low level, for example materials with high atomic numbers. In this case it has been proposed to deposit on or include in the basic structure the X-ray emitting material solely at the place or places designed to be bombarded by the beam of incident electrons, namely, in the case of a rotating anode, solely on the focal track. One of the drawbacks of this arrangement is that the layer of X-ray emitting material, which constitutes the focal track, is deposited on a small width in order to restrict one dimension of the focal spot and, consequently, has a limited area: the layer thus deposited, which generally consists not only of a highly refractive material but also of a material which is a good heat conductor, has a very low volume so that, under the effect of electron bombardment, heat accumulates in this layer which becomes excessively heated and gets unstuck from the basic structure of the anode. Hence, no satisfactory device of this type is known to date.

The present invention relates to a fixed anode or rotating anode X-ray tube which can be used to obtain radiological images in which the sharpness and contrast are considerably improved. This is got by a new arrangement of the anode, which is easy to implement and which enables both a reduction in the extra-focal radiation and the limiting of at least one dimension of the focal spot while, at the same time, retaining those qualities of the anode provided by a massive structure of the X-ray emitting material. It is known by the delivered application DE-B-12 00 962 an anode provided with hollow parts to delimit the focal spot. Meanwhile these grooves constitute, by the fact that they are covered with thermo-emitting material, parasitic X-ray sources.

SUMMARY OF THE INVENTION

According to the invention, there is provided an X-ray tube comprising an anode, at least one cathode producing a beam of electrons, the anode consisting at least partially of a massive layer of an X-ray emitting material, a limited surface of the massive layer being exposed to a bombardment by the beam of electrons, a focal spot that emits a beam of X-rays being produced on said surface exposed to bombardment, said surface exposed to bombardment being demarcated by at least one hollow part in the massive layer of emitting material, the hollow part having a depth which is smaller than a thickness of said massive layer in a vicinity of said hollow part, wherein at least one hollow part is filled with a material having a low atomic number.

BRIEF DESCRIPTION OF THE DRAWINGS

The invention will be better understood from the following description, given by way of a non-restrictive example and made with reference to the appended Figures, of which.

DESCRIPTION OF A PREFERRED EMBODIMENT

Figure 1:
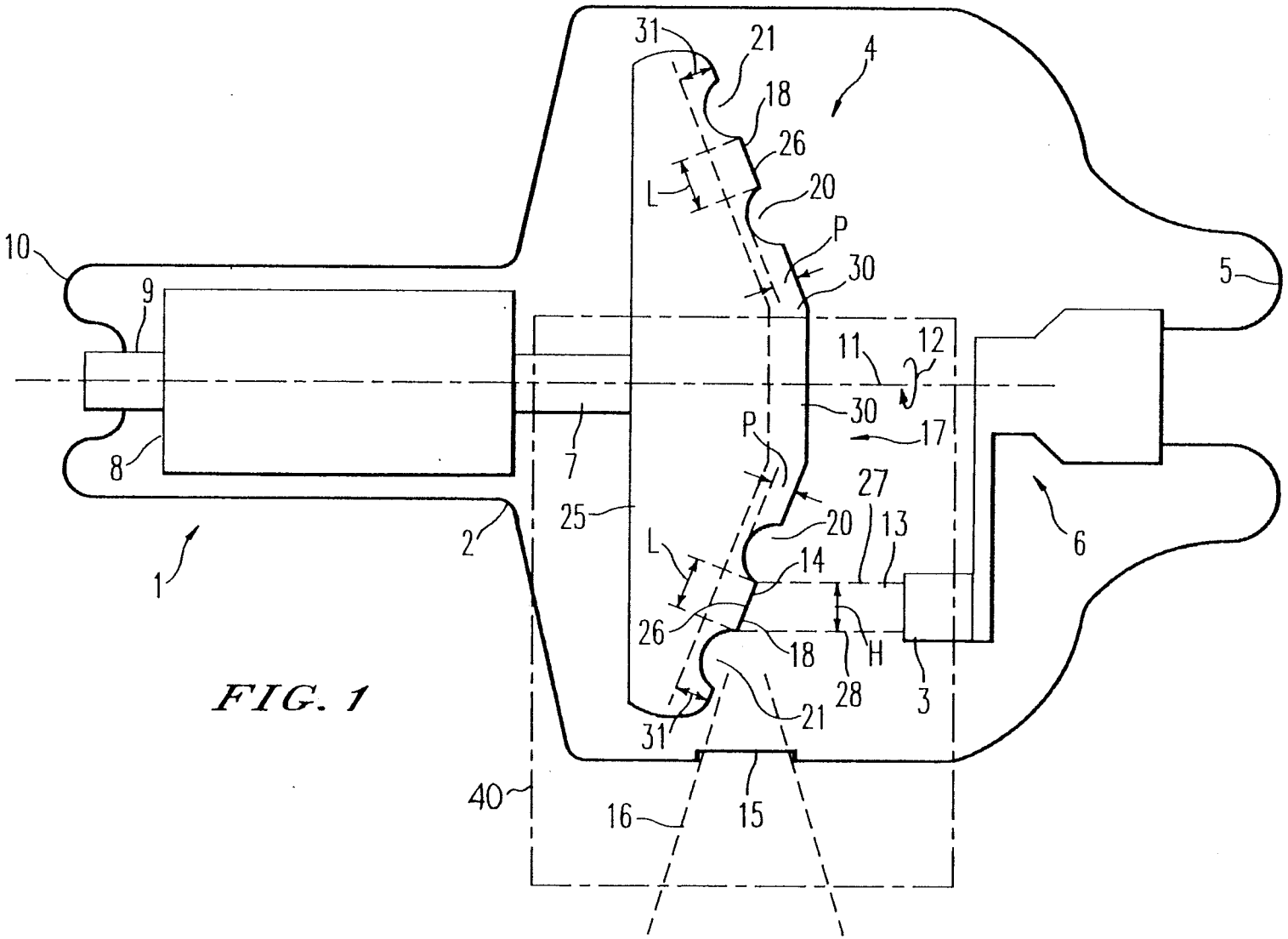
FIG. 1 shows a schematic view of an X-ray tube according to the invention.

FIG. 1 shows an X-ray tube 1 according to the invention, the depiction of which is restricted solely to the elements necessary to understand the invention.

The tube 1 has a casing 2, made of glass, for example, conventionally containing a cathode 3 and an anode 4 placed so that they face each other. The cathode 3 is borne by a first end 5 of the casing 3, by means of a standard support 6. In the non-restrictive example described, the anode 4 is a rotating anode with the general shape of a disk. The anode 4 is borne on a supporting shaft 7 which is rigidly joined to a rotor 8, the rotor 8 being itself borne by a shaft 9 at a second end 10 of the casing 2. The rotor 8 is made to rotate conventionally by means of a stator (not shown) external to the casing 2. The rotor 8 rotates on an axis of symmetry 11 of the anode 4, and causes this anode 4 rotate on the axis of symmetry 11 as shown by the arrow 12 for example.

The anode 4 consists, at least partially, of an X-ray emitting material forming a massive structure, one surface of which constitutes a face 17 of the anode 4 pointed towards the cathode 3, i.e. in the spirit of the invention, the anode 4 may be of the composite type and may comprise, for example, a basic structure 25 with a massive layer 30, i.e. a very thick layer of an X-ray emitting material. The basic structure 25 may be made, for example, of molybdenum, graphite or any other known material known for its use for this purpose.

The term "X-ray emitting material" is used to mean a refractory material which is a good conductor of heat and has a high atomic number, such as materials commonly used to obtain X-radiation under electron bombardment, for example, tungsten, molybdenum, rhenium, their alloys, etc. Materials of this type shall be called target materials in the rest of this description.

During operation, the cathode 3 produces a beam of electrons 13 which bombards the face 17 made of target material, for example tungsten, on a surface 26 exposed to the beam of electrons 13. The beam of electrons 13 creates an X-ray emitting focal spot 14 on this exposed surface 26. The X-radiation is emitted in every direction and leaves the casing 2 through a window 15 in order to form a useful beam of X-rays 16.

As shown in FIG. 1, the beam of electrons 13 is represented between two boundaries 27, 28 between which there is formed a height H of the section of the beam of electrons 13, the projection of which, on the exposed surface 26, tends to form one of the dimensions of the focal spot 14 in a width L of the exposed surface 26.

According to one feature of the invention, the width L of the exposed surface 26 is bounded by a first hollow path and a second hollow path, 20 and 21, made in the face 17 of the anode 4, i.e. in the target material, so that the width L corresponds to a maximum width of the focal spot 14 even when there is an increase in the height H of the beam of electrons 13.

In the non-restrictive example described, where the anode 4 is a rotating anode, the rotation of which leads to a continuous renewal of the surface 26 exposed to the beam of electrons 13, the hollow part or parts 20, 21 being seen along their section, they each form a circle (perpendicular to the plane of the Figure) centred on the axis of symmetry 11. Thus, between the two hollows 20, 21, a focal track 18 is formed with the length L and with all its points successively bombarded by the beam of electrons 13, in a manner which is conventional per se, during the rotation of the anode 4. The first hollow and the second hollow, 20 and 21, respectively form an internal limit and an external limit to the focal track 18.

Thus, it is observed that the focal track 18 consists of a single part with the target material in a massive form, the result of which is perfect heat conduction between the focal track 18 and the rest of the target material, thus preventing excessive heating of the focal track 18.

It can be further noted that the hollows 20, 21 can be used to obtain the desired effects which are, firstly, to limit at least one dimension L of the focal spot 14, and secondly, to limit the extra-focal radiation, namely the unwanted X-radiation. For, assuming that electrons are emitted by the cathode 3 outside the boundaries 27, 28 of the beam of electrons 13, these electrons (not shown) fall mainly in the hollows 20, 21 and a major part of the X-radiation which they are capable of producing in the direction of the beam of X-rays 16 is absorbed in the anode 4 itself. A similar phenomenon also occurs for electrons capable of bouncing off the focal spot 14 and returning to the anode 4.

It must be noted that the effect of absorption of the unwanted X-radiation occurs at each of the hollows 20, 21.

It must be further noted, as indicated above, that it is not necessary for the anode 4 to entirely consist massively of a target material: it is enough for the anode 4 to have, on its face 17 side, the massive layer 30 of target material, the important point being that this massive layer 30 should have a thickness 31 which is greater than a depth P of the hollow part or parts 20, 21 or of at least one of these hollows, so that the focal track 18 is made up of a part with the massive layer 30 of target material. Hence, the term "massive layer" of a target material is used herein to define also a case where the anode 4 itself consists massively of target material.

It must be observed that the invention can be applied equally well to all forms of anodes, namely to cylindrical, semi-cylindrical or truncated cone shaped anodes. Furthermore, the invention can also be applied to the example of fixed anodes by demarcating, according to the same principle, a target formed of a part with the target material as a massive structure.

Figure 2:
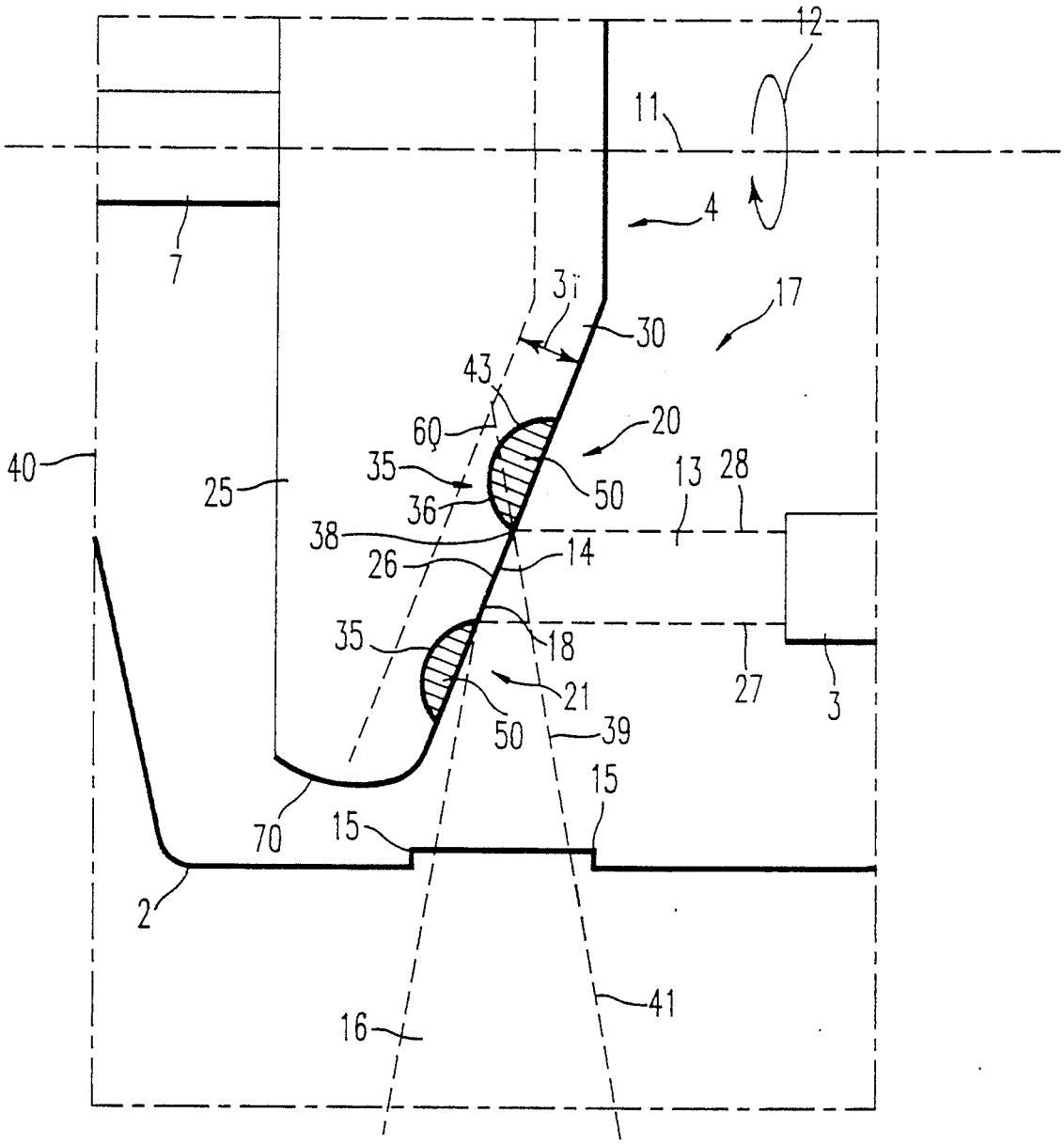
FIG. 2 shows a schematic and partial view of an anode shown in FIG. 1 and illustrates a preferred embodiment of the invention.

FIG. 2 shows an enlarged view of a boxed portion 40 shown in FIG. 1, used to provide a clearer illustration of the effects of the hollows 20, 21 and to illustrate new features of the invention.

The hollows 20, 21 may have a section of any shape, for example a triangular shape or, again, a shape substantially like a portion of a circle as in the non-restrictive example shown in FIG. 2, a shape which is easy to make by machining and which can be used to obtain a good level of absorption of the unwanted X-radiation. The shape of each of the hollows 20, 21 is represented by the contour of a partition wall 35 of these hollows. Of course, the hollows 20, 21 can have different shapes from each other.

Taking the first hollow 20 as an example: electrons (not shown) striking the wall 35 of the furrow 20 produce an unwanted X-radiation emitted in every direction. But it may be observed that any X-radiation emitted in the direction of the beam of X-rays 16 by a relatively large part 36 of the wall 35 is absorbed by the anode 4. This part 36 is demarcated firstly by a junction 38 between the wall 35 and the focal track 18 and, secondly, by an intersection 60 between the wall 35 and an extension 39 of a boundary 41 of the useful beam of X-rays 16. Hence, only electrons that strike a remaining part 43 of the wall 35 are capable of creating X-radiation towards the useful beam of X-rays 16. A similar phenomenon occurs with the second external hollow 21.

In order to further diminish the unwanted X-radiation and, according to another feature of the invention, the hollows 20, 21, are filled with a material or materials 50 (shown in the Figure by hachured lines in the hollows 20, 21) which do not emit X-rays or emit X-rays at a low level, namely materials with low atomic numbers, which have the function of at least partially absorbing electrons that tend to penetrate the furrows 20, 21. The low-level X-ray emitting material or materials 50 are preferably refractory materials which may be electrical insulators or conductors. Materials that can be suitable for this type of application include compounds of boron, silicon, beryllium, carbon, nitrogen etc, for example boron carbide, or silicon carbide or, again, boron nitride, etc.

The hollows 20,21 can be filled by the low-level emitting material 50 through different methods which are conventional per se, for example, by being deposited in melted salt baths (by electrolysis) or, again, by a method of gas phase deposition (CVD, PVD), or by plasma torch deposition or by any other depositing method.

It is also possible, for example, in one and the same operation, to fill the hollows 20, 2!, while at the same time covering the focal track 18, and then to remove the surplus non-emitting material 50, which is on the focal track 18, by a mechanical method for example.

The invention can be applied to configurations different from the one shown in FIGS. 1 and 2. For example, the turn or section 70 of the anode disk 4 may also constitute a face pointed towards the cathode and exposed to bombardment by a beam of electrons, and one or more focal tracks, similar to the focal track 18, may be bounded between the hollows on the surface of the section 70. This surface is then made on a thick layer of target material as explained above.

It must be noted that, in the spirit of the invention, two targets or two focal tracks can be separated by one and the same hollow.

It must be further noted that the hollows can be made on any surface capable of receiving secondary electrons and, especially, in the vicinity of the focal spot 14.

What is claimed is :

1. An X-ray tube comprising an anode, at least one cathode producing a beam of electrons, the anode consisting at least partially of a layer of an X-ray emitting material, a limited surface of the layer being exposed to a bombardment by the beam of electrons, a focal spot (14) that emits a beam of X-rays being produced on said surface exposed to bombardment, said surface exposed to bombardment being demarcated by at least one hollow part in the layer of emitting material, the hollow part having a depth which is smaller than a thickness of said layer in a vicinity of said hollow part, wherein at least one hollow part is filled with a material having a low atomic number.

2. An X-ray tube according to claim 1, wherein the anode is a rotating anode and at least two hollow parts demarcate a focal track (18) on said surface exposed to bombardment by the electron beam.

3. An X-ray tube according to claim 1, wherein the anode is a composite anode comprising a basic structure, the basic structure bearing the layer made of X-ray emitting material.

4. An X-ray tube according to claim 1, wherein the material with a low atomic number is a refractory material.

5. An X-ray tube according to claim 1 or 2 wherein the X-ray emitting material is pure tungsten or tungsten alloy.

6. An X-ray tube according to claim 3 wherein the basic structure is made of pure molybdenum or molybdenum alloy.

7. An X-ray tube according to claim 1 or 2 wherein at least one hollow part has a section shaped like the arc of a circle.

8. An X-ray tube according to claim 1 or 2, wherein the bottoms and the sides of the hollow part are only covered by a layer of material with a low atomic number.

* * * * *